United States Patent [19]

Sayovitz

[11] 4,309,708

[45] Jan. 5, 1982

[54] VEHICLE MOUNTING FOR A PORTABLE MICROWAVE ANTENNA DISH

[75] Inventor: Michael G. Sayovitz, Sunland, Calif.

[73] Assignee: Compact Video Sales, Inc., Burbank, Calif.

[21] Appl. No.: 139,156

[22] Filed: Apr. 11, 1980

[51] Int. Cl.[3] ..... H01Q 1/32

[52] U.S. Cl. ..... 343/713; 343/915

[58] Field of Search ..... 343/713, 840, 915, 916

[56] References Cited

U.S. PATENT DOCUMENTS 3,263,232 7/1966 Burwell et al. ..... 343/916
3,377,595 4/1968 Carr et al. ..... 343/916
4,185,288 1/1980 Dosch et al. ..... 343/713
4,231,044 10/1980 Henkel ..... 343/713

*Primary Examiner*—Eli Lieberman
*Attorney, Agent, or Firm*—Christie, Parker & Hale

[57] ABSTRACT

A dish antenna is supported on a framework which rests on the bed of movable platforms such as the bed of a truck or trailer. Folding legs on the framework can be extended into contact with the ground to support the weight of the antenna. A tension element between the framework and the platform allows the weight of the platform to be suspended from the framework after the supporting legs are in place to anchor the antenna while it is in use.

7 Claims, 7 Drawing Figures

VEHICLE MOUNTING FOR A PORTABLE MICROWAVE ANTENNA DISH

FIELD OF THE INVENTION

This invention relates to a portable dish antenna, and more particularly, is concerned with an antenna which can be supported on the bed of a truck.

BACKGROUND OF THE INVENTION

The use of dish-type microwave antennas for transmitting and receiving signals between a ground location and a communications satellite is well-known. The dish antenna serves as a parabolic reflector or mirror for concentrating the energy of the microwave signal received from the satellite terminal. Typically the parabolic reflector should be of the order of 12 to 18 feet in diameter, and the parabolic shape must be held to extremely close tolerances to minimize distortion. Once the parabolic dish of the antenna is focused on the satellite, the antenna must remain focused on the satellite to maintain effective transmission and reception of the microwave signals. Thus the dish must be made very rigid and provided with a rugged mounting which permits a minimum of movement of the dish antenna due to wind loads and other external forces.

While these conditions can readily be met in a fixed ground installation, it has proved more difficult to provide a portable dish antenna which can be readily moved from location to location as part of a mobile television operation, such as is used for providing live coverage of sporting events, news events and the like. In the past, the antenna has either been directly mounted on the bed of a truck or trailer, or has been designed so that it can be set up and taken down at each location. Directly mounting the antenna on the bed of a trailer or a truck increases the likelihood that the antenna will move or vibrate during use due to external forces acting on the antenna or on the truck bed on which it is mounted. This is particularly troublesome where the equipment housing is also mounted on the truck or trailer bed. People moving around in the equipment housing plus the increased surface of the installation exposed to wind or the like causes the antenna to vibrate and move. If the antenna is to be easily assembled or mounted directly on the ground, it must be made relatively light, thus making it more difficult to anchor securely when set up.

SUMMARY OF THE INVENTION

The present invention is directed to an improved dish antenna mounting arrangement which is mounted on the bed of a truck for moving it from location to location, but which is supported directly on the ground when in use. The arrangement of the present invention allows the antenna structure to remain effectively attached to the truck or trailer, using the weight of the truck or trailer bed to anchor the antenna to the ground while at the same time isolating the antenna from any small movements of the truck or trailer.

These and other advantages of the present invention are achieved by providing a portable dish antenna having a base which rests on a platform such as the bed of a trailer or truck. A plurality of extendable legs are secured to the base, the legs being movable between an extended position and a retracted position. When extended, the legs support the base at a level above the platform. Tension means connects the base to the platform for suspending the platform from the base when the legs are extended.

BRIEF DESCRIPTION OF THE DRAWINGS

For a better understanding of the invention, reference should be made to the accompanying drawings, wherein.

DETAILED DESCRIPTION

Figure 1:
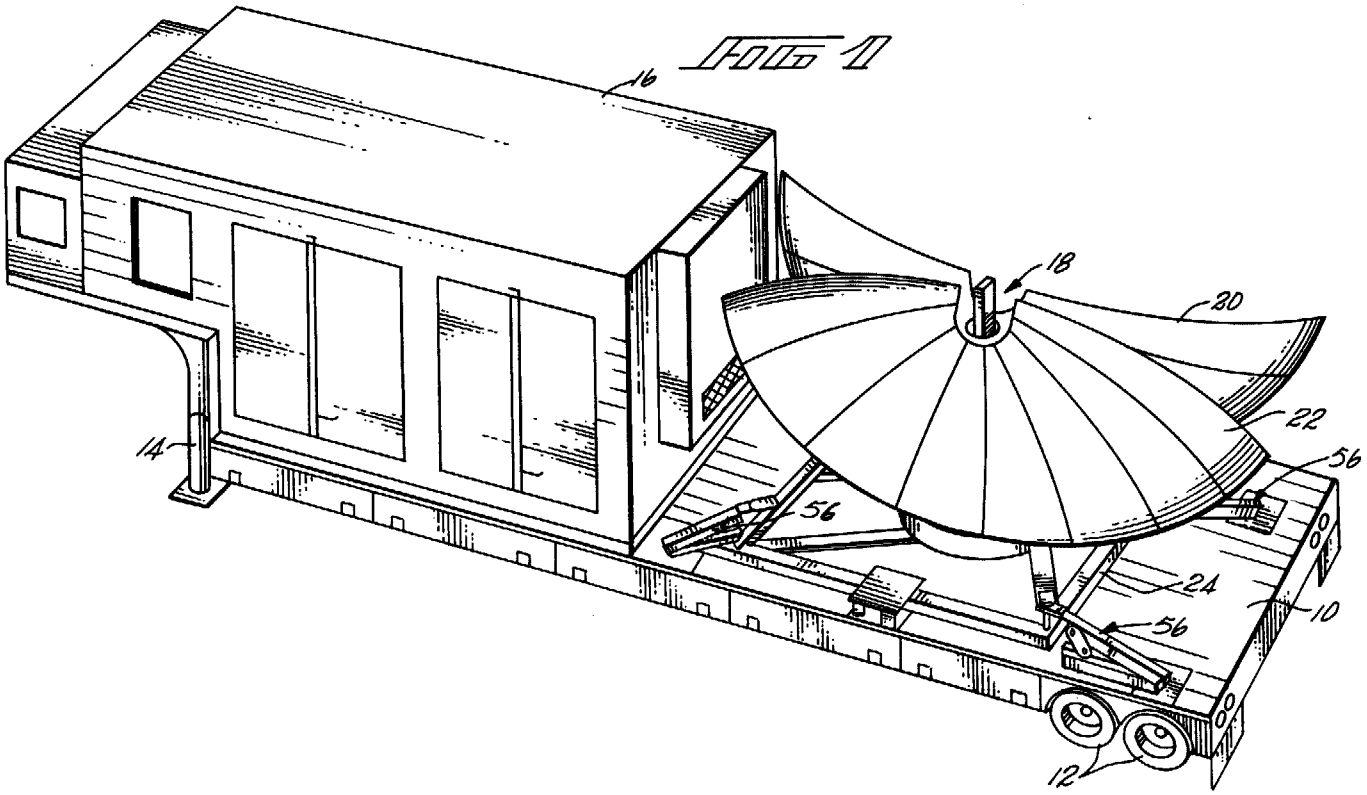
FIG. 1 is a perspective view of a portable television installation incorporating the present invention.

Referring to FIG. 1, there is shown a typical installation of a mobile television operation in which the numeral 10 indicates generally the bed of a trailer normally supported at the rear on wheels 12. The front end of the trailer is designed to engage a truck tractor in conventional manner. When disconnected from the truck tractor, the front of the trailer is supported on adjustable legs 14. An equipment shack or housing 16 is mounted on the forward half of the trailer bed 10 and houses all of the electronic equipment and provides the working space for the television technicians when the mobile television system is in operation.

The dish antenna, indicated generally at 18, is mounted on the rear half of the trailer bed in the manner hereinafter described in detail. As shown in FIG. 1, the dish antenna is arranged in two hinged halves 20 and 22 which are shown in their folded position. The two halves of the dish antenna are supported and moved between the folded and extended positions as described in detail in copending application Ser. No. 139,258 filed Apr. 11, 1980 entitled "Portable Folding Microwave Antenna Dish" and assigned to the same assignee as the present application. The support for the dish antenna includes a framework 24 normally resting on the bed of the trailer 10. The base 24 is temporarily secured to the trailer during transport by conventional load securing chains or the like (not shown).

Figures 2, 3:
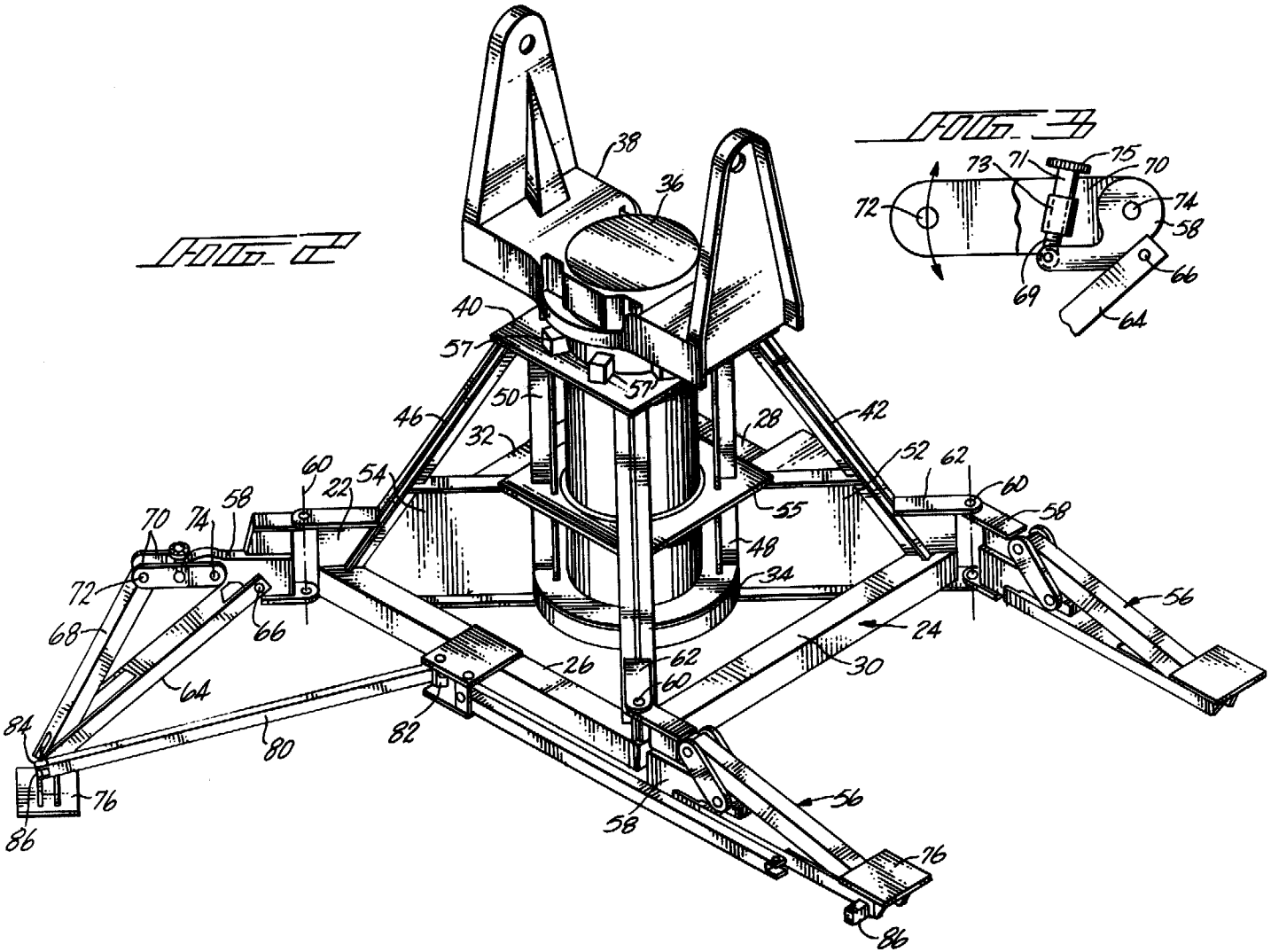
FIG. 2 is an isometric view of the antenna supporting structure.
FIG. 3 is a partial view showing details of the leg locking mechanism.

Referring to FIG. 2, the base framework 24 is shown in more detail. The base includes a substantially open square outer frame including side box members 26 and 28 and front and rear box members 30 and 32. At the center of the frame is a supporting disc 34 which includes a thrust bearing (not shown) for supporting a vertical shaft 36. A yoke 38 is secured to the upper end of the shaft 36 and rotates therewith about a vertical axis. The two halves of the folding antenna dish are supported on the yoke 38 by a hinge arrangement, as described in the above-identified copending application.

The base 24 includes an upper bearing plate 40 which is supported from the corners of the square frame portion of the base by diagonal braces, three of which are indicated at 42, 44 and 46. A plurality of vertical legs, two of which are indicated at 48 and 50, extend between and are secured to the lower disc 34 and the upper bearing plate 40. The whole framework is further stiffened by diagonal H-frame members, two of which are indicated at 52 and 54, extending between the diagonal brace and the vertical legs and joined by an intermediate frame plate 55. The framework of the base is welded into a rigid unit which rotatably supports the shaft 36 in the vertical position. Suitable bearing blocks 57 mounted on the bearing plate 40 engage the outside of the shaft 36 for maintaining rotatable alignment of the shaft.

The base 24 is normally supported on the bed 10 of the trailer for transporting the dish antenna to a particular location. During transportation, the base is temporarily anchored securely to the trailer by load cinching chains (not shown) which are conventionally used to tie down loads during transit. Once on location, the antenna is directly supported on the ground by four extendable leg assemblies 56 secured to the base 24 at each of the four corners. Each leg assembly includes a hinge member 58 which is hinged about a vertical axis 60 to a support member 62 extending diagonally at each corner of the base. A leg member 64 is pivotally supported at its upper end from the hinge member 58 by a pin 66 which allows the leg 64 to swing up and down in a substantially vertical plane. The outer end of the leg member 64 is raised and lowered by a linkage system which includes an outer arm 68 pivotally connected at its outer end to the leg member 64. The arm member 68 is connected to the hinge member 58 by a pair of link arms 70, pivotally connected to the upper end of the arm 68 by a hinge pin 72 and pivotally connected to the hinge member 58 by a hinge pin 74. A foot member 76 is pivotally attached to the lower connection between the leg member 64 and the arm 68, allowing the foot member to be rotated between a lower ground engaging position and an upper storage position when the leg assembly 56 is folded.

The leg assemblies are normally rotated into alignment with the sides 26 and 28 of the base 24 during transit where they are supported in the folded position by the bed 10 of the trailer. When at a desired location, the leg assemblies 56 are rotated through 45 degrees into the diagonal position, and the foot 76 of each leg assembly is lowered into contact with the ground. A side brace 80 is then swung into position about a hinge assembly 82 which provides rotation of the brace about both a vertical and a horizontal axis relative to the base 24. The outer end of the brace 80 is pinned to the lower end of the leg member 64 by a pin 84 passing through a clevice in the end of the brace 80 and through a block 86 rotatably mounted on the hinge axis between the leg member 64 and arm 68.

The link arms 70 are locked to the hinge member as shown in FIG. 3. An eye-bolt 69 is pivotally connected to the hinge member 58 and is threaded into a nut 71 journaled in a block 73. The block in turn is pivotally supported between the link arms 70. By rotating the nut 71, as by a knurled grip 75, the link arms 70 can be rotated relative to the hinge member 58, thereby raising and lowering the foot member 76. The eye-bolt is screwed out of the nut to allow the leg assembly to be fully retracted.

Figure 6:
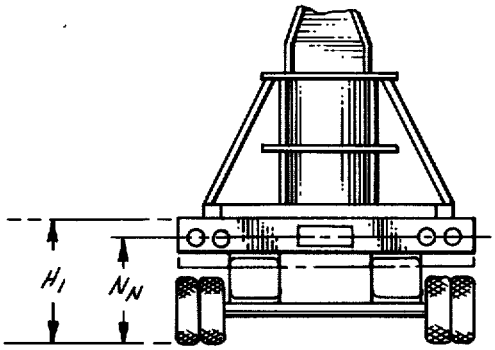
FIG. 6 is a rear view of the trailer with the antenna structure in its stored condition.

Once the folding leg assemblies 56 are deployed into their extended diagonal antenna supporting positions, the entire antenna assembly is raised. This is preferably accomplished by utilizing a trailer having an air bag type suspension system by which the bed 10 of the trailer is supported on the wheels 12. By inflating the air bags, the bed of the trailer can be raised to its maximum height $H_1$ as shown in FIG. 6. This can be done either before or after the folding leg assemblies are extended. However, with the trailer bed raised to its maximum height, the legs, when extended, are locked in position so that the full weight of the antenna structure may transfer to the supporting legs. Once locked, the air bags are deflated, allowing the bed of the trailer to be lowered, thereby transferring the entire support of the antenna through the extended legs to the ground independently of the trailer.

Figure 4:
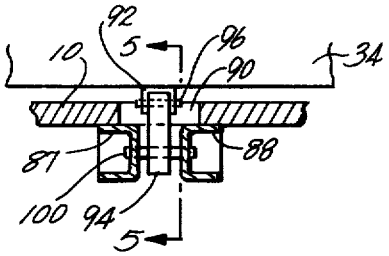
FIG. 4 is a detailed sectional side view of the linkage between the antenna base and the bed on which it is normally transported.
Figure 5:
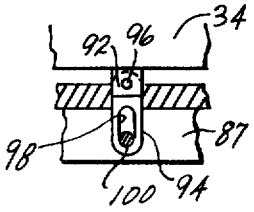
FIG. 5 is a rear view of the linkage of FIG. 4.

One of the features of the present invention is that the weight of the trailer bed is used as an anchor for the antenna structure. To this end, the supporting disc 34 is linked to the bed of the trailer, as shown in FIGS. 4 and 5. The frame of the trailer includes a pair of closely spaced structural channel members 87 and 88. The bed 10 of the trailer has an opening 90 which is positioned to receive a channel-shaped bracket 92 secured to and projecting downwardly from the bottom of the supporting disc 34. A link member 94 is pivotally secured to the bracket 92 by a pin 96. The link 94 has an elongated slot 98 which extends downwardly between the channel members 87 and 88. A retaining pin 100 extending between the channel members passes through the slot 98.

Figure 7:
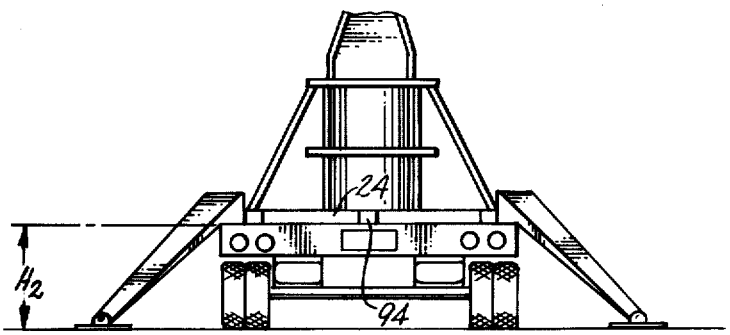
FIG. 7 is a rear view of the trailer with the antenna structure in its operative condition.

When the air bags are deflated, the bed 10 of the trailer drops down until the retaining pin 100 engages the bottom of the slot 98 and the link 94. In this position, the weight of the trailer is transferred through the link 94 and the supporting disc 34 to the extended leg assemblies 56 of the antenna support structure. In this position, although the wheels 12 remain on the ground, the air bags do not support any of the weight of the trailer bed. Thus, as shown in FIG. 7, the trailer is suspended below and spaced from the base 24. In this manner, the weight of the trailer bed is used to anchor the antenna against wind loads while substantially isolating the antenna structure from slight rocking or vibrational movements of the trailer.

What is claimed is:

1. A portable dish antenna comprising:

a base, a dish antenna, means mounting the dish antenna on the base, vehicle having a platform positioned below the base, and wheels for moving the platform, the base normally resting on the platform and movable therewith on said wheels, a plurality of extendable legs secured to the base, the legs being movable between an extended position and a retracted position, the legs when extended supporting the base at a level above the platform, means for raising and lowering the platform relative to the wheels to lift the platform and the antenna base before the legs are extended and lower the platform to transfer the weight of the antenna on to the extended legs and separate the platform from the base, and tension means connecting the base to the platform when the platform is lowered for suspending the weight of the platform from the base and the extended legs.

2. Apparatus of claim 1 wherein the means mounting the dish antenna includes a rotatable member mounted on the base for rotation about a vertical axis, the rotatable member including a yoke, a tilt member supported by and between the ends of the yoke and rotatable about a horizontal axis, the dish antenna being secured to the tilt member.

3. Apparatus of claim 1 wherein hinge means connects each of the extendable legs to the base for rotation of the legs about a vertical axis.

4. Apparatus of claim 3 wherein each extendable leg includes a leg member pivotally attached to the hinge member for vertical movement of the leg member, an arm pivotally connected to the outer end of the leg member, a rotatable link connecting the arm to the hinge member, and means locking the link to the hinge member to lock the leg member in its lowered position.

5. A portable microwave antenna system, comprising vehicle means including wheels, a load supporting surface, and means secured to the wheels for raising and lowering the load supporting surface relative to the wheels, an antenna including a reflecting dish, a base, and means supporting the dish on the base, the base being supported on said surface, foldable legs secured to the base, the legs being movable between a folded position and an extended position, the legs when extended engaging the ground with the supporting surface raised by said means for raising and lowering the load supporting surface, and tension means suspending the weight of vehicle from the base when the load supporting surface is lowered with the legs in the extended position and supporting the antenna, said tension means providing a hinged coupling under tension between the base and the vehicle.

6. Apparatus of claim 5 wherein the tension means includes a link pivotally connected to the base and to the vehicle.

7. Apparatus of claim 6 wherein the link has a slot with a pin extending through the slot, the pin engaging one end of the slot when the vehicle is lowered to provide limited vertical movement between the base and the vehicle before the weight of the lowered vehicle is transferred to the base and legs.

* * * * *